US006541690B1

(12) United States Patent
Segers, Jr.

(10) Patent No.: US 6,541,690 B1
(45) Date of Patent: Apr. 1, 2003

(54) SCRATCH EFFECT CONTROLLER

(76) Inventor: Jerry W. Segers, Jr., 1233 Roper Rd., Canton, GA (US) 30115

( * ) Notice: Subject to any disclaimer, the term of this patent is extended or adjusted under 35 U.S.C. 154(b) by 0 days.

(21) Appl. No.: 10/020,738

(22) Filed: Dec. 18, 2001

(51) Int. Cl.[7] ..... G10H 7/00
(52) U.S. Cl. ..... 84/605; 84/743
(58) Field of Search ..... 84/605, 600, 723, 84/743

(56) References Cited

U.S. PATENT DOCUMENTS

| | | | | |
|---|---|---|---|---|
| 4,813,327 | A | 3/1989 | Abe | |
| 5,065,013 | A | 11/1991 | Taylor | |
| 5,159,143 | A | 10/1992 | Emi et al. | |
| 5,256,832 | A | 10/1993 | Miyake | |
| 5,350,882 | A | 9/1994 | Koguchi et al. | |
| 5,512,704 | A | 4/1996 | Adachi | |
| 5,569,912 | A | 10/1996 | Turk et al. | |
| 5,763,874 | A | 6/1998 | Luciano et al. | |
| 6,025,552 | A | 2/2000 | Mukaino et al. | |
| 6,379,244 | B1 * | 4/2002 | Sagawa et al. | 434/307 A |
| 2001/0017821 | A1 * | 8/2001 | Inoue et al. | 369/32 |
| 2001/0017832 | A1 * | 8/2001 | Inoue et al. | 369/53.34 |

* cited by examiner

*Primary Examiner*—Jeffrey Donels
(74) *Attorney, Agent, or Firm*—Salzman & Levy

(57) ABSTRACT

There is provided a rotary encoder having the physical characteristics of a vinyl phonograph disc on a properly prepared turntable. A disc jockey (DJ) may intuitively use this encoder in a virtually identical manner to a conventional record to create scratch effects in a digital signal being supplied from a digitized audio signal source such as a CD, mini-disc, digital audio tape (DAT), data file or any other source of a digital signal. Speed and direction information from the encoder are used as inputs to a digital signal processor so that scratch effects typically produced by the manipulation of a vinyl record on a turntable may be simulated in the digital signal.

13 Claims, 4 Drawing Sheets

SCRATCH EFFECT CONTROLLER

FIELD OF THE INVENTION

This invention relates to digital encoding devices and, more particularly, to a rotary encoder for use in adding scratch effects to digital signals, especially audio signals.

BACKGROUND OF THE INVENTION

The rapid replacement in recent years of the analog, vinyl phonograph disc with digital signal sources, notably the compact disc (CD), has, for the most part, been enthusiastically received. It seems difficult to believe that this transition in audio signal sources could possibly have any drawbacks. However, disc jockeys and the like who use various audio signal sources for providing entertainment over the radio or in more local settings have discovered at least one disadvantage. Disc jockeys, or DJs as they are often. called, use physical manipulation of one or more phonograph records to create myriad special audio effects. Some of these manipulations are called "scratching" or, in more formal settings, turntablism. DJs use special turntables and special turntable slip mats which allow controlled slippage between the disc and the turntable platter, as well as other specialized equipment to perform these manipulations. There are schools and workshops where an aspiring DJ may enroll to learn the fine points of these manipulations. As in any specialized field, names like baby scratch, hamster style, twiddle scratch, bubble scratch, tear scratch, etc. all have specific and well recognized meanings within the DJ fraternity.

The problem is that the vast majority of these effects involve, at least in part, physical manipulation of a record on a turntable to alter the sound. Once a digital signal source such as a CD is used, no physical manipulation is possible. Attempts have been made to simulate some of the well known scratch effects using digital signal processing techniques on an audio signal, regardless of its source.

U.S. Pat. No. 5,512,704 for ELECTRONIC SOUND SIGNAL GENERATOR ACHIEVING SCRATCH SOUND EFFECT USING SCRATCH READOUT FROM WAVEFORM MEMORY, issued Apr. 30, 1996 to Jun Adachi, teaches one such apparatus for generating a scratch sound effect in combination with a musical instrument or other electronic sound generator. ADACHI's scratch effect is applied to individual tones being generated within the musical instrument, by controlling the rate and direction of readout of a digitized waveform from memory within the musical instrument.

In contradistinction, the inventive system uses a record-like transducer as an input to a digital signal processor. By using specific algorithms, physical manipulations of the inventive transducer which simulate the well-known manipulations of a disc may be used as input to a digital signal processor (DSP). These input signals may then be used to alter the digital stream being fed to the DSP such that the anticipated effect is close, possibly even indistinguishable from an analog, hand-generated scratch effect. ADACHI teaches no such transducer nor does he teach the scratching of an audio stream from a CD player or other such signal source.

U.S. Pat. No. 5,350,882 for AUTOMATIC PERFORMANCE APPARATUS WITH OPERATED ROTATION MEANS FOR TEMPO CONTROL, issued Sep. 27, 1994 to Satoru Koguchi, et al., teaches an encoder for changing the direction and/or tempo of the performance of a musical instrument. A disc moved by a performer in either a forward or reverse direction at a particular velocity generates timing signals which may be interpreted to set the tempo or another parameter of a performance.

The encoder of the present invention is adapted to simulate in size, speed, and feel the familiar phonograph record so that a DJ, having perfected often difficult disc manipulations, may transfer his/her knowledge to a new medium without need for extensive retraining and/or practice. KOGUCHI, et al. provide no such encoder nor do they teach the application of their apparatus to a digital audio signal stream comprising music from a CD or a similar signal source.

U.S. Pat. No. 5,159,143 for INFORMATION RECORDING MEDIUM PLAYER FOR CONTROLLING MUSICAL DEVICES USING A MUSICAL INSTRUMENT DIGITAL INTERFACE (MIDI) FORMAT SIGNAL, issued Oct. 27, 1992 to Tetsuro Emi, et al., teaches the combining of MIDI control information on a CD or similar signal source. Using this technique, predefined control information is available to allow a MIDI-equipped musical instrument to "play along" with the prerecorded music. EMI, et al. do not teach the generation of any scratch effect using a rotary encoder.

U.S. Pat. No. 4,813,327 for MUSICAL TONE CONTROL SIGNAL GENERATING APPARATUS FOR ELECTRONIC MUSICAL INSTRUMENT, issued Mar. 21, 1989 to Yasunao Abe, discloses a device for bending pitches being generated by a musical instrument. There is no teaching of any apparatus or method for adding scratch effects to an audio signal supplied from a digital signal source such as a CD.

U.S. Pat. No. 5,256,832 for BEAT DETECTOR AND SYNCHRONIZATION CONTROL DEVICE USING THE BEAT POSITION DETECTED THEREBY, issued Oct. 26, 1993 to Atsushi Miyake, teaches a device for detecting a beat position in an audio signal. The intended use of the MIYAKE apparatus is in providing synchronization between tracks in a multi-track recording environment. While beat detection could and typically would be useful in producing certain well-known scratch effects, much more information is needed to produce those effects. MIYAKE teaches no rotary encoding device nor is there taught any method for producing scratch effects in an audio signal stream.

U.S. Pat. No. 6,025,552 for COMPUTERIZED MUSIC APPARATUS PROCESSING WAVEFORM TO CREATE SOUND EFFECT, A METHOD OF OPERATING SUCH AN APPARATUS, AND A MACHINE-READABLE MEDIA, issued Feb. 15, 2000 to Hirofumi Mukaino, et al., teaches an apparatus and method for adding pseudo scratch effects to digitally encoded sounds. Both a pad and a ribbon controller are utilized to control the generation of the scratch effects. MUKAINO, et al., however, do not teach a disc-like rotary encoder for generating scratch control input signals.

U.S. Pat. No. 5,065,013 for OPTICAL ENCODERS USING TRANSMITTED AND REFLECTED LIGHT DETECTION AND HAVING COMPLEMENTARY OUTPUT, issued Nov. 12, 1991 to Robert M. Taylor; U.S. Pat. No. 5,569,912 for OPTICAL VELOCITY MEASURING WITH EFFICIENT USE OF RADIATION PASSING THROUGH PATTERNS OF DISCS, issued Oct. 29, 1996 to Everardus T. G. Turk, et al.; and U.S. Pat. No. 5,763,874 for INCREMENTAL OPTICAL ENCODER HAVING PARTIALLY OPAQUED QUADRATURE DETECTORS, issued Jun. 9, 1998, all teach rotary optical encoders possibly suitable for constructing a disc-like rotary encoder for use with the present invention. However, none of these patents teaches such an encoder or suggests the use of such an encoder in an application such as generating scratch effects in a digitized audio signal supplied from a digital signal source such as a CD.

None of these patents, either individually or in combination, teaches or suggests a disc-like rotary encoder for creating scratch effects in an audio signal from a digital signal source.

It is therefore an object of the invention to provide a rotary encoder simulating a phonograph record for use as an input device to a digital scratch effect apparatus.

It is a further object of the invention to provide a rotary encoder simulating a phonograph record having a feel simulating a vinyl disc on a conventional turntable.

It is an additional object of the invention to provide a rotary encoder simulating a phonograph record which is intuitive to use.

It is another object of the invention to provide a rotary encoder simulating a phonograph record providing both speed and direction signals to a microprocessor-based digital signal processor for generating scratch effects.

SUMMARY OF INVENTION

The present invention provides a rotary encoder having the physical characteristics of a vinyl phonograph disc on a properly prepared turntable. A disc jockey (DJ) may intuitively use this encoder in a manner virtually identical to a conventional record and turntable to create scratch effects in a digitized musical signal being supplied from a digital signal source such as a CD, mini-disc, digital audio tape (DAT) or any other source of a musical signal. Speed and direction information from the encoder are used as inputs to a digital signal processor so that scratch effects typically produced by the manipulation of a vinyl record on a turntable may be simulated in the digital audio signal. The digital signal processing may be accomplished by a dedicated digital signal processor or by a digital signal processing program running on a general purpose digital computer such as a personal computer (PC).

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Figure 1:
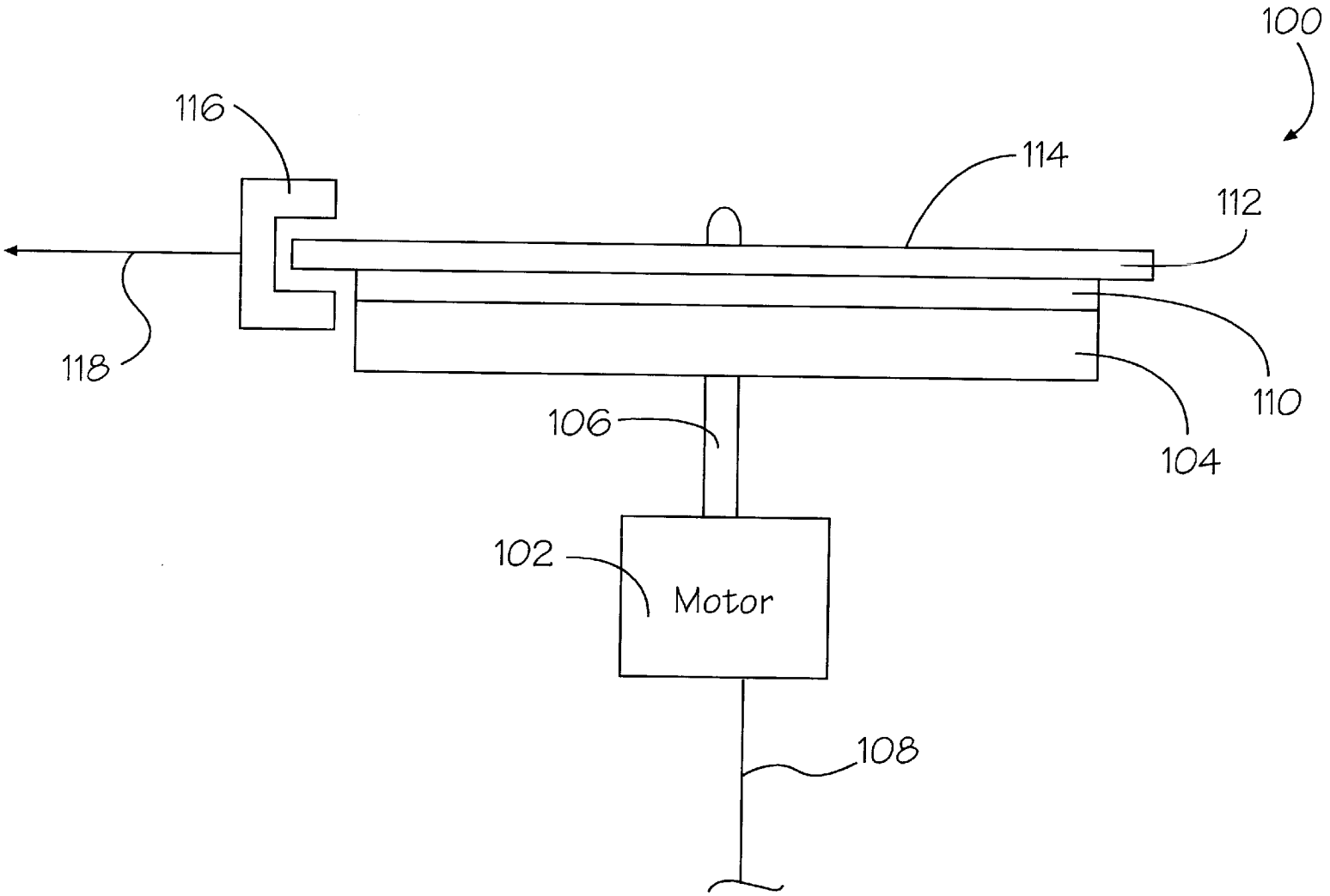
FIG. 1 is a side sectional schematic view of the encoder of the invention.

Referring first to FIG. 1, there is shown a side, sectional schematic view of the inventive encoder 100 (i.e., the computer to disc jockey interface device). A motor 102 is attached to a circular platter 104 by a shaft 106. Motor 102 may be one of a variety a different conventional motor types. The essential operating characteristics of motor 102 are that it operate within the desired speed range and generate sufficient torque to allow the manipulation of the encoding surface in a desirable manner by a user. While a direct drive connection between motor 102 and platter 104 has been shown for purposes of disclosure, it will be obvious that belt drive or other similar drive arrangements well known to those skilled in the design of audio turntables could readily be used. Power for motor 102 is provided from a power source (not shown) through cable 108. The choice of a power source will depend on the motor 102 selected and forms no part of the present invention.

Platter 104 will typically be metallic and have sufficient mass to provide the necessary inertia to remain at a constant angular velocity despite pressure from a user generating scratch effects thereupon. A slip disc 110, typically made from felt, is placed on the top surface of platter 104. An encoding disc 112 is placed atop slip disc 110. A central spindle 114 keeps encoding disc concentric with platter 104 and slip disc 110. The coefficient of friction between the slip disc 110 and encoder disc 112 is within a predefined range of values. If there is not enough friction, encoder disc 112 will not be turned by platter 104. If there is too much friction, it will be difficult to slow encoder disc 112 so as to generate the desired scratch effects.

Concentricity is also important because eccentric movement of encoding disc 112 could potentially introduce unintended distortions, particularly in the velocity signal being generated by encoding disc 112. These distortions could alter the intended scratch effect. The overall design of encoder 100 is not unlike an audio turntable and many of the well-known design practices known to those of skill in that art may be incorporated.

An optical pick-up 116 is provided to receive velocity and direction information from encoding disc 112. The exact configuration of pick-up 116 is dependent upon the configuration of encoding disc 112. Either reflective or see-through configurations are possible. The design and use of optical pick-ups with encoding discs is well known to those of skill in the art and the actual configuration of pick-up 116 forms no part of the instant invention. Typically, optical pick-up assembly 116 contains an illuminator and a receptor (not shown). Illuminators such as light-emitting diodes (LEDs), small incandescent lamps, etc. may be used. Receptors such as photo diodes and photo transistors are typically used for optical pick-up applications. A cable 118 is connected to optical pick-up 116 to provide power to the illuminator and to carry the output signal from the receptor to external electronics (not shown) for conditioning and further processing. In alternate embodiments, an external light source (not shown) could be coupled by a fiber optic strand (not shown) terminating at an operating position within optical pick-up 116.

Figure 2A:
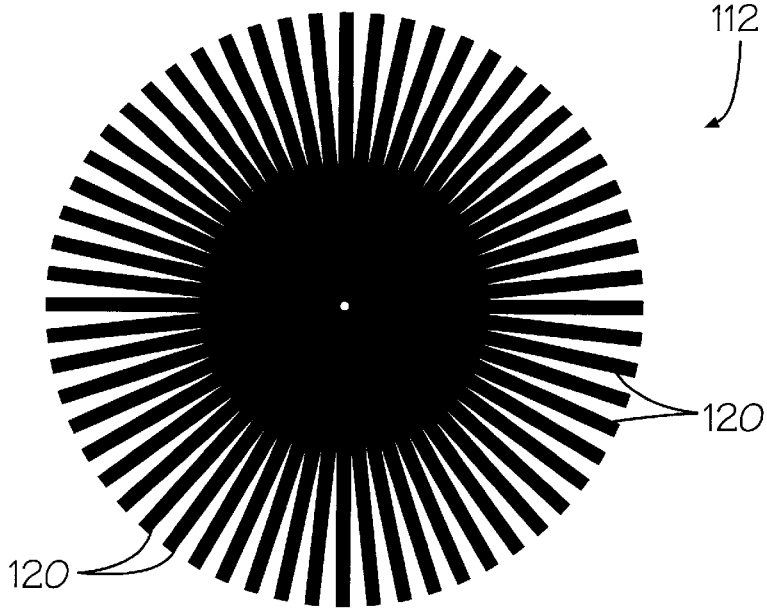
FIGS. 2*a* and 2*b* show two possible embodiments of optical encoding discs suitable for use in the inventive encoder.
Figure 2B:
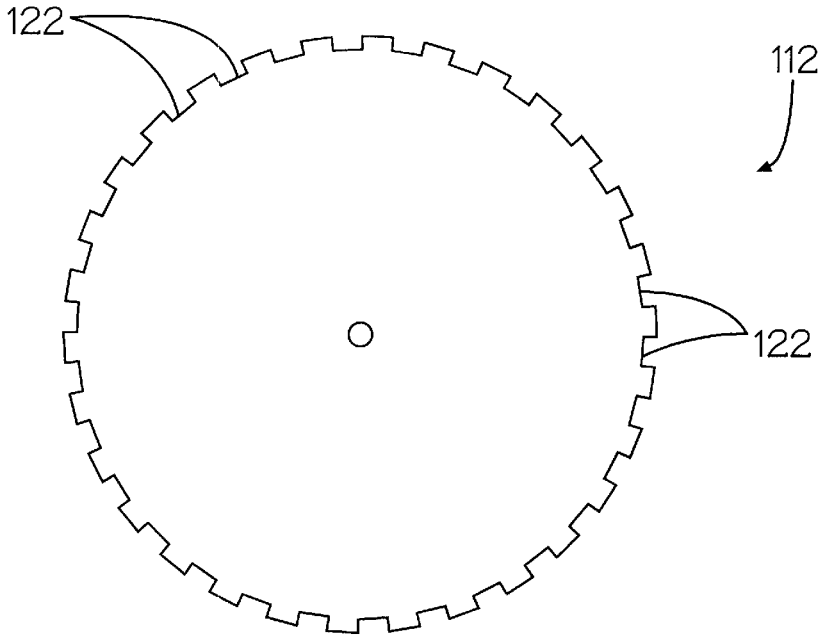

Referring now also to FIGS. 2*a* and 2*b*, there are shown two possible embodiments of encoding disc 112. The encoding disc 112 of FIG. 2*a* utilizes a series of radial lines 120 terminating at the periphery of disc 112. These lines 120 are precisely spaced one from another and are typically produced by a photo-lithographic process on clear vinyl, glass or the like. Pick-up assembly 116, either in a reflective or see-through mode of operation, produces an output signal each time one of the lines 120 passes optical pick-up 116. Only a small number of lines 120 has been shown for clarity. It will be understood that many more lines must be present on the actual encoder disc 112 so that the encoder 100 may resolve very small angular changes. In alternate embodiments, multiple sensors (not shown) could be used to provide enhanced angular resolution.

The embodiment of encoder disc 112 shown in FIG. 2*b* has uniformly spaced slots 122 machined into the periphery of disc 112. These slots 122 behave very much like lines 120 in that each time a slot 122 passes pick-up 116, an output signal is generated. As with lines 120, a very large number of closely-spaced notches 122 are required to provide satisfactory angular resolution for use in the inventive encoder, unless multiple sensors are used.

It should be obvious that many other patterns or styles of encoder disc could be utilized in the rotary encoder of the invention.

Figure 3:
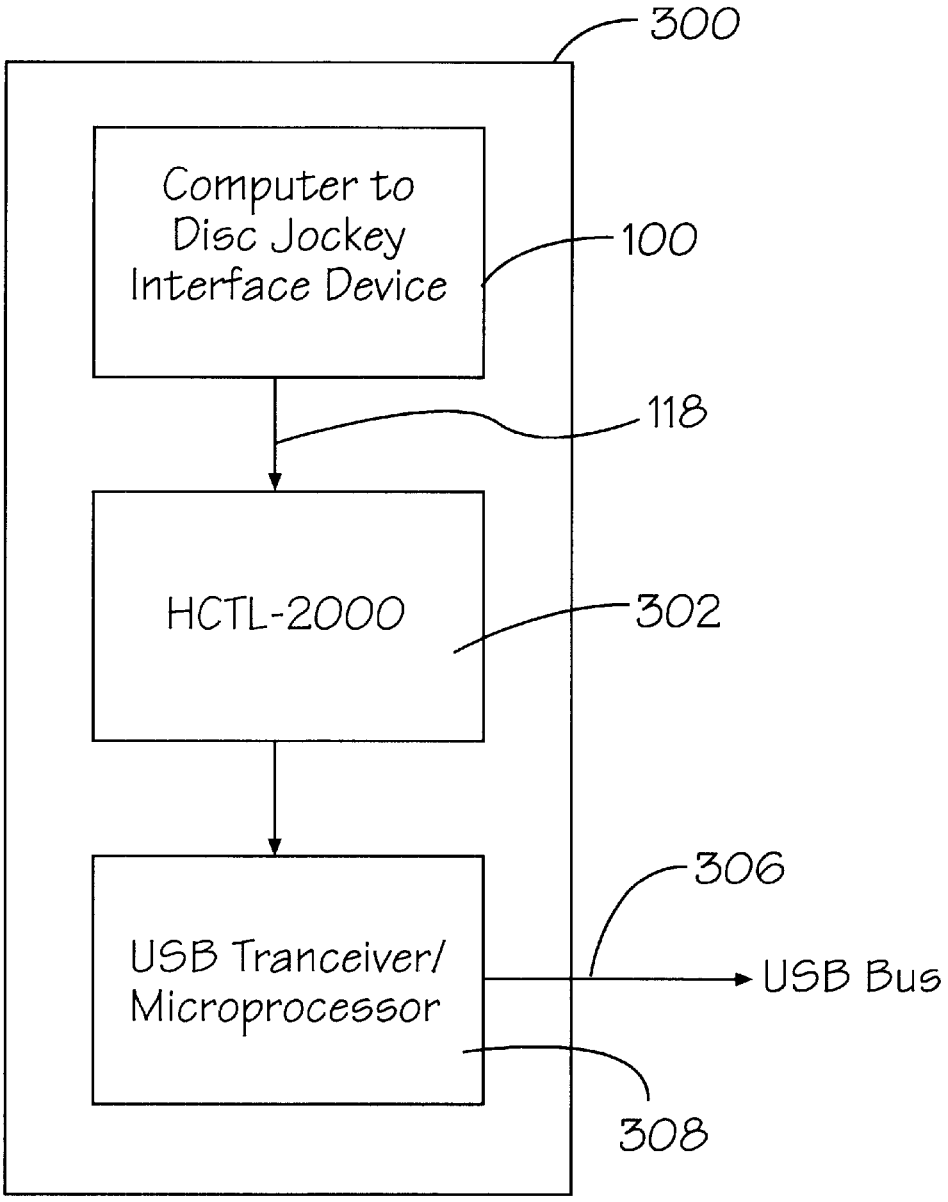
FIG. 3 is a schematic block diagram of the DJ to computer interface of the invention.

Referring now to FIG. 3 there is shown a simplified block diagram of a preferred embodiment of the inventive encoder 300. The physical rotary encoder (i.e., the computer to disc jockey interface device) 100 is connected to a quadrature decoder/counter IC 302 via cable 118. In the embodiment chosen for purposes of disclosure, IC 302 is a type HCTL-2000 integrated circuit manufactured by Agilent Technologies. IC 302 provides a high level hardware interface between a microprocessor and an encoder (e.g., encoder disk 112/pick-up 116). It features a 12-bit counter and a 14 MHz clock rate. It should be obvious that other similar integrated circuits from other manufacturers could also be used. Also, the functions performed by IC 302 could be implemented using multiple, lower level integrated circuit chips. The output of IC 302 is connected to a universal serial bus (USB) interface transceiver 304. A typical device found suitable for this application is a type NET2890 Rev. 2B manufactured by Netchip Technology, Inc. has been found suitable for use in the application. Cable 306 from transceiver 304 is equipped with a suitable connector for pluggable connection to a standard USB port on a computer or a USB hub.

The USB provides an extremely easy way to quickly connect diverse input/output (I/O) devices to a computer. The USB interface is well known to those skilled in the art and, as such, warrants no further explanation here.

In operation, manipulation of encoder disc 112 by the hand of a user ultimately results in digital signals representative of the manipulation, the signals having both direction and velocity components. These signals are converted to standard USB signals and provided at a USB cable/connector 306.

Figure 4:
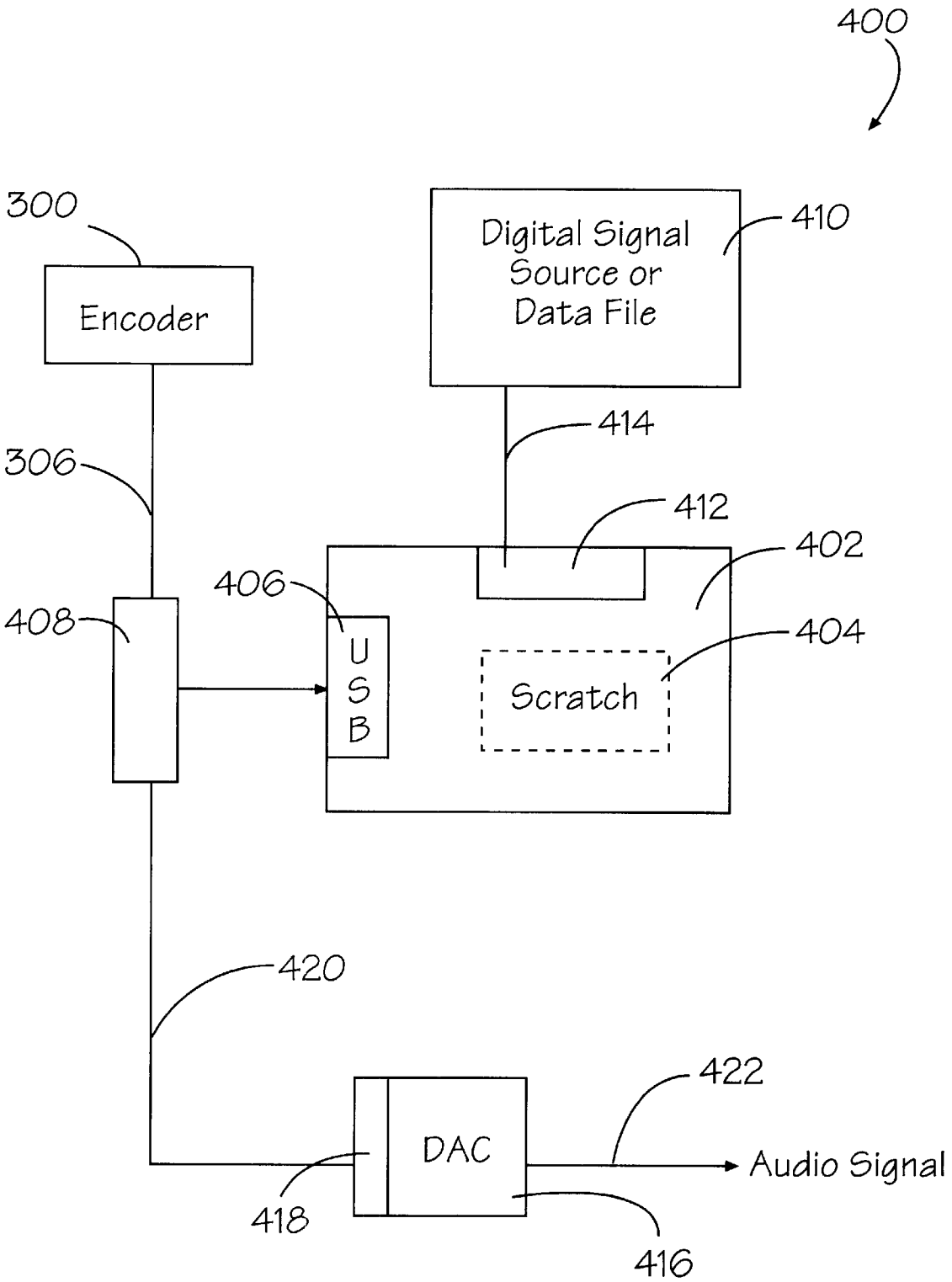
FIG. 4 is a system block diagram showing the encoder of the invention used as an input device to a digital scratch generating system.

Referring now to FIG. 4, there is shown a system block diagram of a typical scratch effect producing apparatus utilizing the inventive encoder 300 (FIG. 3), generally at reference number 400. A general purpose personal computer 402 runs a software program 404 similar to "TerminatorX" which is adapted to receive digital control signals and to manipulate a digital data stream (i.e., digitized music, etc.) from a digital signal source such as a CD, mini-disc, DAT, computer data file, etc. TerminatorX is a real time audio synthesizer that allows the addition of scratch affected to sampled audio data, typically .wav, .au, .mp3 and similar files. TerminatorX run under the Linux® operating system and is licensed under the GNU General Public License (version 2). Consequently, source code is readily available for customization. As supplied, TerminatorX supports data input from any mouse like device which makes integration with the inventive encoder relatively simple. TerminatorX supports virtual turntables, real time digital effects and an easy-to-use graphical user interface (GUI). Information regarding TerminatorX is available at www.Eudormail.com.

TerminatorX is a software package representative of a variety of software programs adapted to modify digital data streams so that when the data stream is converted to sound by a digital-to-analog converter (DAC), the analog signal appears to have been manipulated as though by traditional turntable-based techniques. While PC running digital signal processing software has been shown for purposes of disclosure, it should be obvious that a dedicated digital signal processor (DSP) could easily be substituted.

Computer 402 is equipped with a USB interface 406. USB interface 406 is connected to a USB hub 408. Encoder 300 is connected to USB hub 408 by cable 306. A digital signal source or data file 410 is connected to a digital I/O interface 412 in computer 402 via cable 414. It should be noted that while CDs have been chosen as the preferred digital data source for purposes of disclosure, the digital data directly from the CD, and not an analog audio signal, is provided to I/O interface 412. Digitized data processed using any digital signal encoding or compression standard may be used with suitable modifications to the software routines (i.e., TerminatorX, etc.) or a dedicated DSP. A digital-to-analog converter 416 having a USB interface 418 is connected to USB hub 408 by USB cable 420. The output from DAC 416 is an analog audio signal 422. Analog audio signal 422 may be passed to an amplifier and speakers, to an audio recorder, or utilized in any manner in which normal analog audio signals are used.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A computer interface for producing scratch effects in a digitized signal, comprising:

a) a rotary encoder apparatus for receiving manual manipulation from a user and for producing a digital control signal representative of said manual manipulation, wherein said rotary encoder apparatus comprises:

i) a motor having a driven shaft;

ii) a substantially circular platter having an upper surface and being rigidly and concentrically affixed to said driven shaft;

iii) a substantially circular slip disc having an upper surface and being disposed concentrically on said upper surface of said platter and affixed thereto;

iv) a substantially circular encoder disc disposed concentrically with and proximate said upper surface of said slip disc and in a slidable relationship therewith, said encoder disc comprising a pattern for interaction with a pick-up;

v) pick-up means proximate said encoder disc and adapted for interaction with said pattern for generating a digital control signal representative of at least the angular velocity and rotational direction of said encoder disc;

b) processing means for receiving said digital control signal and a digitized audio signal, said processing means running at least one software program capable of modifying said digitized audio signal in a predetermined manner dependent upon said control signal, thereby producing a modified digitized audio signal;

c) digital-to-analog conversion means for receiving said modified digitized audio signal and providing an analog audio signal representative thereof;

whereby through manipulation of said rotary encoder, said user may impart a scratch effect to said digitized audio signal.

2. The computer interface for producing scratch effects in a digitized signal as recited in claim 1, said rotary encoder apparatus further comprising a USB interface operatively connected to said pick-up means and adapted for communicating said digital control signal to said processing means.

3. The computer interface for producing scratch effects in a digitized signal as recited in claim 1, wherein said encoder disc has tactile feel to said user substantially the same as a vinyl record on an audio turntable.

4. The computer interface for producing scratch effects in a digitized signal as recited in claim 1, wherein the coefficient of friction between a lower surface of said encoder disc and said upper surface of said slip disc is within a predetermined range of values.

5. The computer interface for producing scratch effects in a digitized signal as recited in claim 1, wherein said processing means comprises personal computer.

6. The computer interface for producing scratch effects in a digitized signal as recited in claim 5, wherein said personal computer comprises at least a USB interface, a digital input port and a digital output port.

7. The computer interface for producing scratch effects in a digitized signal as recited in claim 1, wherein said pattern of said encoder disc comprises at least one of the group: regular notches spaced about the periphery of said encoder disc and a pattern of indicia on a face of said encoder disc.

8. The computer interface for producing scratch effects in a digitized signal as recited in claim 1, wherein said pick-up means comprises optical sensing means.

9. The computer interface for producing scratch effects in a digitized signal as recited in claim 8, wherein said optical sensing means comprises at least one from the group: reflective optical sensor and see-through optical sensor.

10. The computer interface for producing scratch effects in a digitized signal as recited in claim 9, wherein said optical sensing means comprises at least an illuminator and a receptor.

11. The computer interface for producing scratch effects in a digitized signal as recited in claim 10, wherein said illuminator comprises at least one from the group: light-emitting diode (LED) and incandescent lamp.

12. The computer interface for producing scratch effects in a digitized signal as recited in claim 10, wherein said receptor comprises at least one from the group: photo diode and photo transistor.

13. The computer interface for producing scratch effects in a digitized signal as recited in claim 1, wherein said processing means comprises a digital signal processor (DSP).

* * * * *